United States Patent [19]

Moon

[11] Patent Number: 4,974,299

[45] Date of Patent: Dec. 4, 1990

[54] SPEED CLOSURE SYSTEM FOR FOOTWEAR

[76] Inventor: Chang O. Moon, 134-33 Kocheok-Dong, Kuro-Ku, Seoul, Rep. of Korea

[21] Appl. No.: 480,799

[22] Filed: Feb. 16, 1990

[30] Foreign Application Priority Data

Nov. 23, 1989 [KR] Rep. of Korea ..... 89-17308

[51] Int. Cl.[5] ..... A43C 5/00

[52] U.S. Cl. ..... 24/714.6; 24/714.7; 24/714.9

[58] Field of Search ..... 24/714.7, 714.8, 714.9, 24/714.4, 714.5, 714.6, 715; 36/50

[56] References Cited

U.S. PATENT DOCUMENTS

| | | | |
|---|---|---|---|
| 595,833 | 12/1897 | McElroy . | |
| 712,003 | 10/1902 | Payne | 24/714.7 |
| 872,037 | 11/1907 | White . | |
| 1,043,003 | 10/1912 | Faegre . | |
| 1,296,529 | 3/1919 | Koester . | |
| 1,434,723 | 11/1922 | Triay, Jr. . | |
| 1,466,075 | 8/1923 | Triay, Jr. . | |
| 1,505,430 | 8/1924 | Roberts et al. | 24/714.8 |
| 1,548,407 | 8/1925 | Chisholm | 24/714.9 |
| 1,850,781 | 3/1932 | Weingarten | 24/714.8 |
| 2,239,324 | 4/1941 | Hills . | |
| 2,239,325 | 4/1941 | Hills . | |
| 2,867,021 | 1/1959 | Wittl | 24/714.7 |
| 3,169,325 | 2/1965 | Fesl . | |
| 3,333,304 | 8/1967 | Daddona, Jr. . | |
| 4,255,876 | 3/1981 | Johnson | 36/83 |
| 4,373,275 | 2/1983 | Lydiard | 36/129 |
| 4,413,431 | 11/1983 | Cavanagh | 36/50 |
| 4,553,342 | 11/1985 | Derderiane et al. | 36/50 |

FOREIGN PATENT DOCUMENTS

| | | | |
|---|---|---|---|
| 0048089 | 4/1910 | Switzerland | 24/714.6 |
| 0005822 | 5/1885 | United Kingdom | 24/714.6 |

*Primary Examiner*—Victor N. Sakran

*Attorney, Agent, or Firm*—Birch, Stewart, Kolasch & Birch

[57] ABSTRACT

A speed closure system for footwear, which includes a first shoelace provided with a plurality of loops which extend through a plurality of eyelets around a throat or a tongue opening in the upper portion of the shoe and a second shoelace adapted to be laced through the plurality of loops, whereby the second shoelace can be easily adjusted to suit the comfort of the wearer by pulling one of the ends of the second shoelace.

3 Claims, 2 Drawing Sheets

SPEED CLOSURE SYSTEM FOR FOOTWEAR

BACKGROUND OF THE INVENTION

1. Field of the Invention

The present invention relates to an improved speed closure system for footwear and more particularly, to a speed shoelace closure system for use on an athletic shoe used for running or jogging, a military shoe or a combat shoe for soldiers, and the like.

2. Description of the Prior Art

Various types of closure systems for footwear are well known in the art. Thus the closure system for footwear is important to its comfort and fit. In principle, most closure systems serve to secure the shoe upper portion against the foot and in addition, to shorten its wearing operation time. Traditionally, such closure systems for athletic and other shoes have included shoelaces which are threaded through eyelets around a throat or a tongue opening in the upper portion of the shoe. The placement of the eyelet rows, particularly their distance from a point where the sole and upper portion meet, influences the effect the laces will have in cinching the upper portion against the foot. Also, the closure systems must be able to adapt to feet of various widths and to varying personal preferences about snugness of fit.

It has also been found advantageous to employ "speedlaces" in athletic shoes. "Speedlaces" employ wide shoelace openings which are larger than the uncompressed cross-section of the shoelace to permit a single pull on the end of the shoelace to easily pull the shoelace through all the openings and tighten the shoelace throughout its lacing pattern with uniform tension. One type of currently available "speedlaces" is formed of a plastic bar from which a plurality of aligned large eyelets extend. Such closure systems are shown in the U.S. Pat. Nos. 595,833 to McElroy; 872,037 to White; 1,043,003 to Faegre; 1,296,529 to Koester; 1,434,723 to Triay; 1,466,075 to Triay; 2,239,324 to Hills; 2,239,325 to Hills; 3,169,325 to Fesl; 3,333,304 to Daddona; 4,255,876 to Johnson; 4,373,275 to Lydiard,; 4,413,431 to Cavanagh; and 4,553,342 to Derderian et al.

However, such closure systems suffer from a number of difficulties such as, for example, it is complicate to operate and it is difficult to secure the shoe upper portion against the foot since the shoelace is adapted to be laced through at least some of solid eyelets and the solid eyelets are disposed a solid upper portion so that by pulling on the ends of the shoelace, the shoelace cannot easily adjust due to the friction resistance generated from a plurality of contacting areas between the shoelace and the solid eyelets and solid upper portion. Furthermore, such closure systems cannot substantially utilize the conventional footwear as well as the shoelace can be easily cut and when the shoelace cuts, the shoelace cannot be adjusted to suit the comfort of the wearer.

SUMMARY OF THE INVENTION

Accordingly, it is an object of the present invention to provide an improved speed closure system for footwear.

Another object of the present invention is to provide a speed closure system for footwear such as athletic shoes, combat boots, and the like, which includes a first shoelace provided with a plurality of loops which extend through a plurality of eyelets around a throat or a tongue opening in the upper portion of the shoe and a second shoelace adapted to be laced through the plurality of loops, whereby since the loops prevent from generating the friction resistance, the second shoelace can be easily adjusted to suit the comfort of the wearer by pulling one of the ends of the second shoelace.

A further object of the present invention is to provide a speed closure system including, a first shoelace and a second shoelace so that when one of both shoelaces is cut, the other shoelace can be employed through the eyelets same as the conventional shoe.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a speed closure system for footwear, which includes a first shoelace provided with a plurality of loops which extend through a plurality of eyelets around a throat or a tongue opening in the upper portion of the shoe and a second shoelace adapted to be laced through the plurality of loops, whereby the second shoelace can be easily adjusted to suit the comfort of the wearer by pulling one of the ends of the second shoelace.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
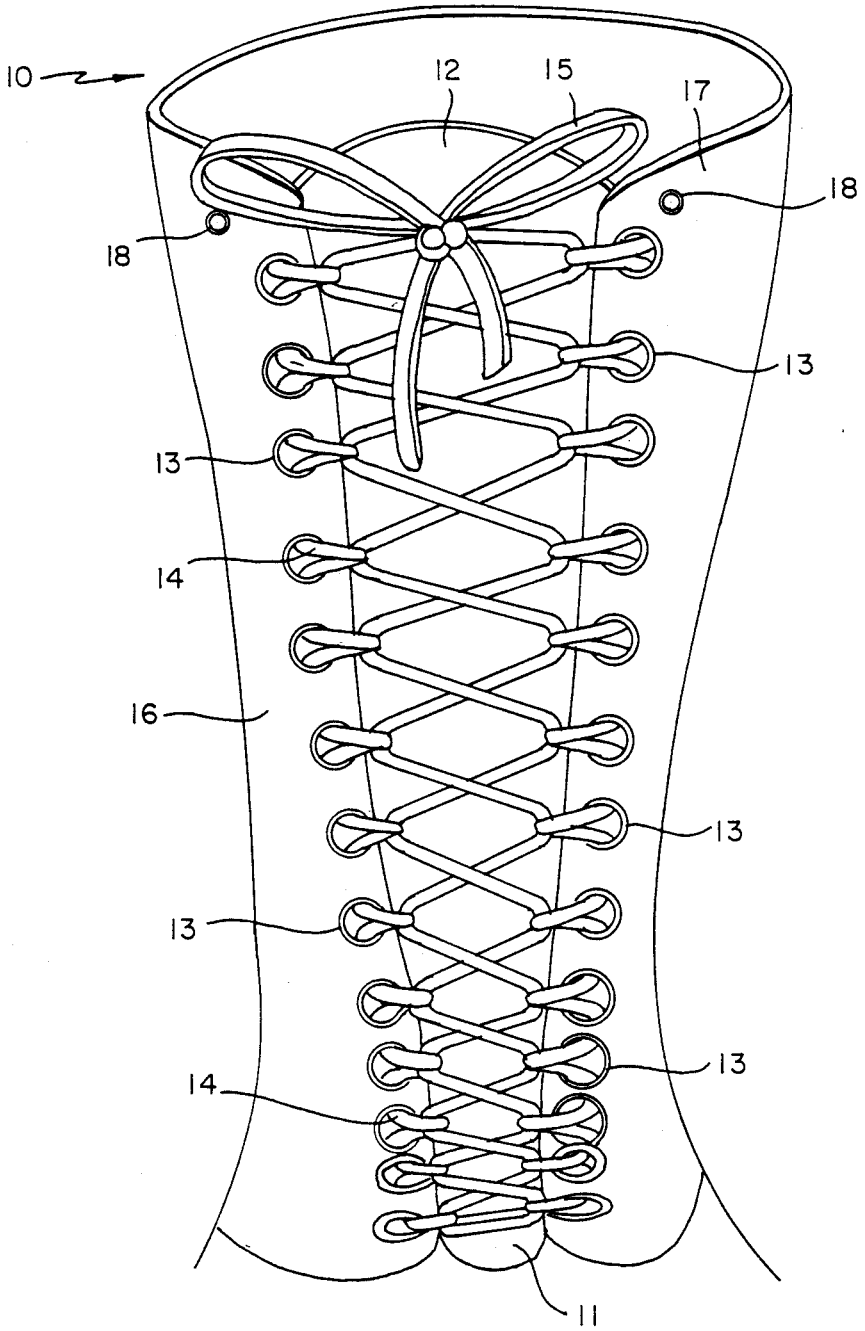
FIG. 1 is a front elevational view of the speed closure system for footwear, for example, a combat boot according to the present invention.
Figure 2:
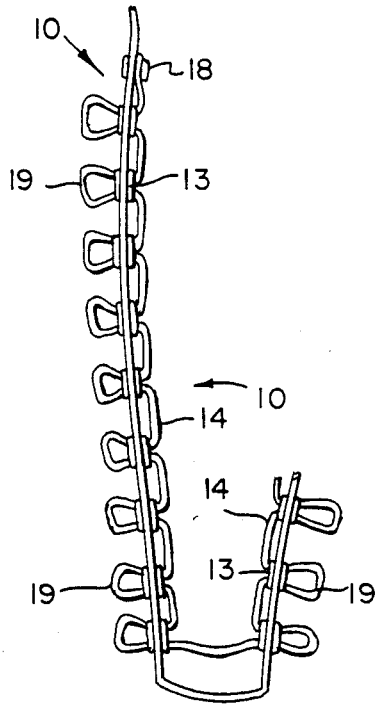
FIG. 2 is a front elevational view showing a plurality of loops which extend through a plurality of eyelets of the combat boot according to the present invention.

Referring now in detail to the drawings for the purpose of illustrating preferred embodiments of the present invention, the speed closure system for footwear as shown in FIGS. 1 and 2 which comprises a shoe upper portion 10 and a shoe lower portion (not shown), the upper portion 10 including a medial throat portion 11, a tongue 12, a plurality of eyelets 13, a first shoelace 14, and a second shoelace 15. The upper portion 10 is generally made of solid material.

The medial throat portion 11 with opposing lateral edges 16 and 17. The tongue 12 is disposed in the medial throat portion 11. The plurality of eyelets 13 are disposed along the opposing lateral edges 16 and 17. The eyelets 13 are made of solid material such as metal or plastic. The opposing lateral edges 16 and 17 are provided with a pair of rivets 18 disposed at the top portion thereof.

As shown in FIG. 2, the first shoelace 14 is provided with a plurality of loops 19 which extend through the plurality of eyelets 13. Also, the first shoelace 14 is fixed to the pair of rivets 18.

As shown in FIG. 1, the second shoelace 15 is laced through the plurality of loops 19 formed around the plurality of eyelets 13. Therefore, the second shoelace 15 can be easily adjusted to suit the comfort of the wearer by pulling on the ends of the second shoelace 15.

In the footwear according to the present invention, the friction resistance may not be generated even though the second shoelace 15 is slidably contacted with the plurality of loops 19 during wearing the footwear . Therefore, it takes approximately 2 seconds for wearing the footwear according to the present invention when compared with about 30 to 60 seconds of the conventional footwear. On the other hand, in the conventional footwear, the friction resistance can be substantially generated by contacting the shoelace with the solid eyelets and solid upper portion of the footwear.

In the footwear according to the present invention, when one of both first and second shoelaces 14 and 15 is cut, the other can be readily laced through the plurality of eyelets 13. Accordingly, it is very convenient in usage.

Figure 3:
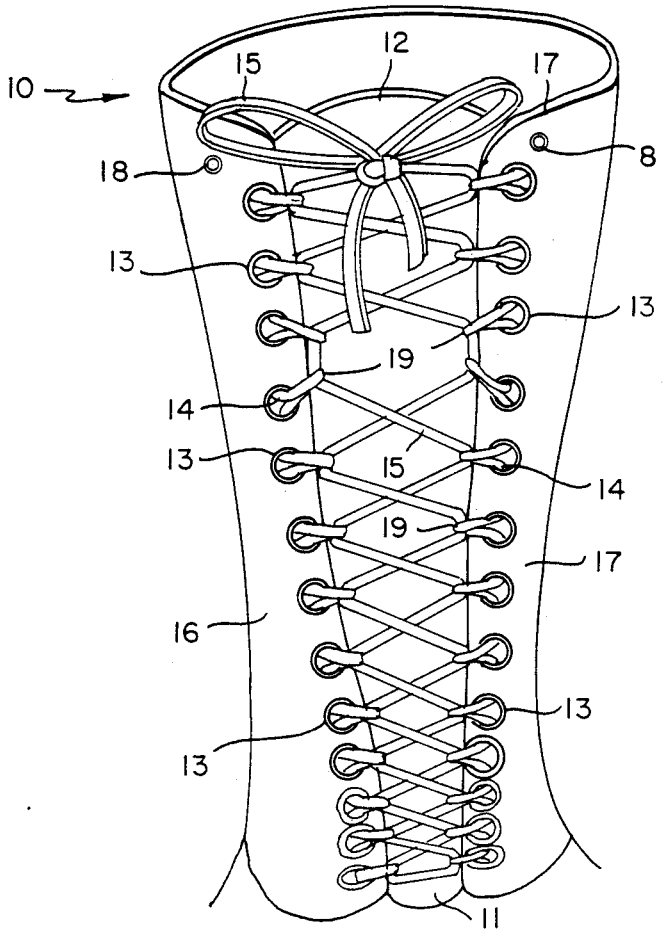
FIG. 3 is a front elevational view of the speed closure system for footwear, for example, the combat boot according to the present invention illustrating the second shoelace can be laced through two loops as a composite structure.

As shown in FIG. 3, the second shoelace can be laced through two loops 19 as a composite structure it may be shortened the wearing operation time when compared with the footwear of FIG. 1 according to the present invention.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A speed closure system for footwear, which comprises:

a shoe upper portion and a show lower portion, said shoe upper portion including:

a medial throat portion provided with opposing lateral edges, a tongue disposed in said medial throat portion, a plurality of eyelets disposed along said opposing lateral edges, a first shoelace provided with a plurality of loops, each loop extending through one of said plurality of eyelets, said first shoelace fixed to a pair of rivets disposed at the top portion of said opposing lateral edges, and a second shoelace laced through each of said plurality of loops, whereby by pulling on the ends of the second shoelace, the second shoelace can be easily adjusted to suit the comfort of the wearer since the loops prevent the generation of the friction resistance and when one of both shoelaces is cut, the other can be laced immediately through the plurality of eyelets.

2. The speed closure system for footwear of claim 1, wherein the second shoelace is laced through at least two loops as a composite structure.

3. The speed closure system for footwear of claim 1, wherein the second shoelace is laced through two loops as a composite structure.

* * * * *